US005758516A

United States Patent [19]

Uematsu

[11] Patent Number: 5,758,516

[45] Date of Patent: Jun. 2, 1998

[54] ACCESSORIES FOR ACCOMMODATING FINGER RING

[76] Inventor: Hajime Uematsu, Abitashion fukamachi 305, 4-19-1, Higashikaizawa-machi, Takasaki-shi, Gunma, Japan

[21] Appl. No.: 695,770

[22] Filed: Aug. 8, 1996

[30] Foreign Application Priority Data

Aug. 21, 1995 [JP] Japan ..... 7-234673

[51] Int. Cl.[6] ..... A44C 25/00

[52] U.S. Cl. ..... 63/23; 63/1.14

[58] Field of Search ..... 63/1.14, 15.8, 63/18, 19, 21, 23, 35; 24/3.6

[56] References Cited

U.S. PATENT DOCUMENTS

| | | | |
|---|---|---|---|
| 3,670,524 | 6/1972 | Korwin | 63/18 |
| 5,488,848 | 2/1996 | Huang | 63/23 X |
| 5,495,734 | 3/1996 | Yu | 24/3.6 |
| 5,511,390 | 4/1996 | Mah | 63/1.14 |

FOREIGN PATENT DOCUMENTS

| | | |
|---|---|---|
| 52-17192 | 2/1977 | Japan . |
| 56-70815 | 6/1981 | Japan . |
| 59-34630 | 3/1984 | Japan . |
| 3005792 | 1/1995 | Japan . |
| 7-11918 | 2/1995 | Japan . |

*Primary Examiner*—Kien T. Nguyen
*Attorney, Agent, or Firm*—Oliff & Berridge, PLC

[57] ABSTRACT

To permit an engage ring or a marriage ring to be worn on the body without fitting on any finger, a case constituted by a body and a lid is provided with a ring accommodating section to fully or partly accommodate a ring. The case is also provided with a an attaching tool, such as a pin to be attached to the clothing or a chain to be worn round the neck. The case may be made transparent or semitransparent so that an accommodated ring in it can be seen from the outside. The case has openings to permit a portion of the accommodated ring to project or be exposed outward and be seen from the outside. The case may be provided with a plurality of ring accommodating sections in the forms of circular grooves having different diameters for accommodating the ring part of a ring.

8 Claims, 6 Drawing Sheets

ACCESSORIES FOR ACCOMMODATING FINGER RING

BACKGROUND OF THE INVENTION

1. Field of the Invention

This invention relates to accessories for accommodating finger ring, which can accommodate an engagement ring, a marriage ring, etc. and can be worn round the neck like necklaces or on the wrist like bracelets or attached to garments like a broach.

2. Prior Art

Engagement rings, marriage rings, etc. are well known in the art. In the past, engage rings were given from men to women. Recently, however, many women give engagement rings to men. Some men don't like wearing the engagement ring. This is mainly because the man generally hesitates wearing the engagement ring.

However, it is wasteful to store a ring given as a gift in a chest or the like instead of wearing it. Sometimes, one forgets the place where the ring is stored.

An object of the invention is to provide an accessory for accommodating finger ring, which can be worn on the body just like such accessories as pendants, necklaces or broaches instead of wearing on a finger like engagement rings or marriage rings and can also be put in a sideboard or the like for display.

SUMMARY OF THE INVENTION

The accessory for accommodating finger ring according to the invention, can fully or partly accommodate a ring in the case, and is provided with an attaching member such as a pin to be attached to the clothing or chain to be worn round the neck. A ring thus can be worn on the body without fitting it on any finger by accommodating it in the case and attaching the attaching member to the body or the clothing. The case is provided with openings to permit part of the accommodated ring to project or be exposed outward so as to be seen from the outside. The ring accommodating section is formed as a circular groove to permit the ring part of ring to be readily set and prevent occasional movement of the accommodated ring. The case may be provided with a plurality of ring accommodating sections in the forms of circular grooves having different diameters to permit rings of different sizes to be accommodated.

BRIEF DESCRIPTION OF PREFERRED EMBODIMENTS

First Embodiment

Figure 1A:
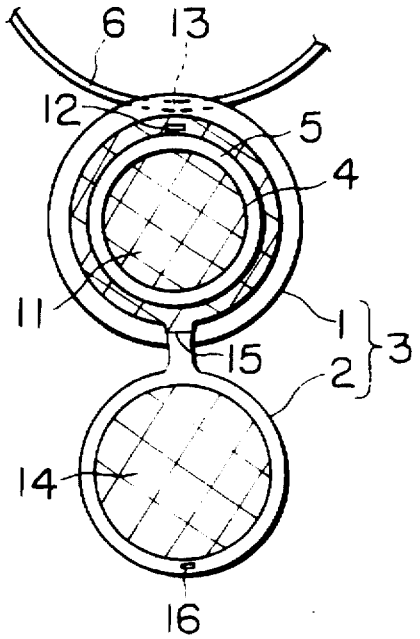
FIGS. 1(*a*) to 1(*c*) show a first embodiment of the invention, FIG. 1(*a*) being a front view showing the accessory with a lid thereof opened and the ring accommodated, FIG. 1(*b*) being a front view showing the same accessory in a closed state, FIG. 1(*c*) being a sectional view showing the same with the lid opened and the ring accommodated.

A first embodiment of the invention will now be described in detail with reference to FIGS. 1(*a*) to 1(*c*). The accessory for accommodating a finger ring shown in FIGS. 1(*a*) to 1(*c*), is suited for accommodating a marriage ring having a semicylindrical shape. The accessory comprises a case 3, which includes a body 1 formed in round shape and a lid 2 having a shape smaller than and similar to the body 1 and hinged to the body 1 for being opened and closed.

The body 1 is made of metals, resins, leather, etc., and it accommodates a ring setting member 11, which is formed by covering such elastic material as foamed styrol, sponge, etc. with soft cloth, e.g., velvet, or leather or like material. The ring setting member 11 has a ring accommodating section 5 like a circular groove, in which a marriage ring 4 can be fully pushedly inserted. The ring setting member 11 has an engagement section 12 formed in its upper portion. The engagement section 12 is in the form of a hole or a recess for engaging the lid 2. As shown in FIG. 1(*c*), the body 1 has a through hole 13 formed in its upper edge portion, an attaching member 6 such as a chain or a string being passed through the through hole 13.

The lid 2, like the body 1, is made of such material as metals or resins, and accommodates a retainer 14, which is formed by covering such elastic materials as foamed styrol, sponge, etc. with soft cloth such as velvet or leather. The lid 2 has its lower edge portion hinged by a pin 15 to the body 1. The lid 2 has a lock pawl 16 penetrating its upper edge portion from the outside to the inside of it for being engaged in the engagement section 12. The lock pawl 16 has its outside portion formed with a nipping portion 20, which is to be pulled for releasing the lock pawl 16 from the engagement in the engagement section 12.

Second Embodiment

A second embodiment of the invention will now be described in detail with reference to FIGS. 2(*a*) to 2(*c*). The accessory for accommodating finger ring as shown in FIGS. 2(*a*) to 2(*c*), is suited for accommodating an engagement ring with an ornament stone. Like the case of FIGS. 1(*a*) to 1(*c*), this accessory comprises a case 3 including a body 1 and a lid 2 hinged thereto. As shown in FIG. 2(*a*), the body 1 accommodates a ring setting member 11, which has a central ring accommodating section 5 in the form of a truly circular groove and an upper ring accommodating section 5 in the form of a semicircular groove. The upper ring accommodating section 5 communicates with openings 7 formed in the periphery of the body 1, so that a ring 4 accommodated in the upper ring accommodating section 5 has an upper portion projecting outward from the openings 7. The ring setting member 11 has an engagement section 12 formed in its upper portion for engaging the lid 2. As shown in FIG. 2(*a*), the body 1 has a through hole 13 formed in its edge portion for passing an attaching member 6 such as a chain or a string.

Figure 1B:
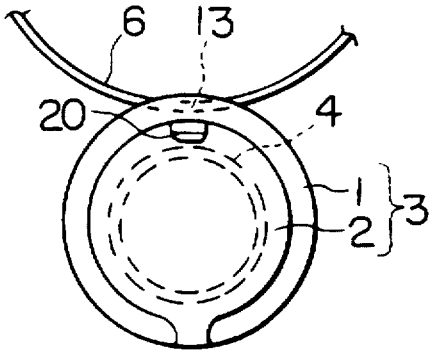
Figure 1C:
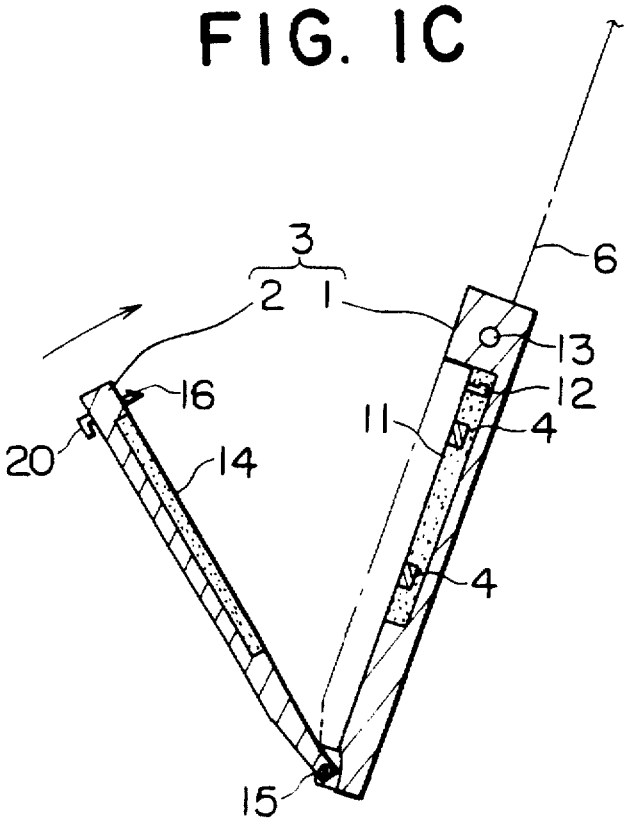
Figure 2A:
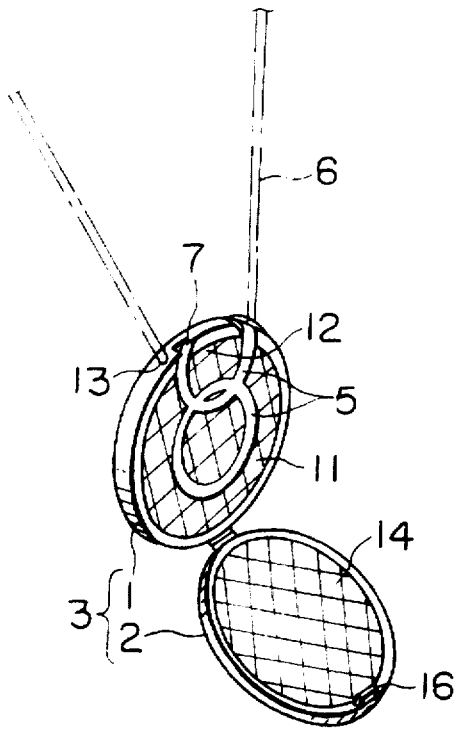
FIGS. 2(*a*) to 2 (*c*) show a second embodiment of the invention, FIG. 2(*a*) being a perspective view showing the accessory with a lid thereof opened, FIG. 2(*b*) being a perspective view showing the same accessory with the lid opened and a ring accommodated, and FIG. 2(*c*) being a sectional view showing the same with the lid opened and the ring accommodated.
Figure 2B:
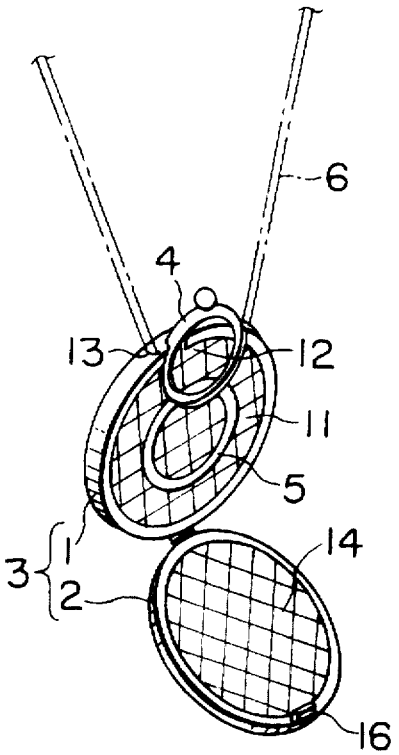
Figure 2C:
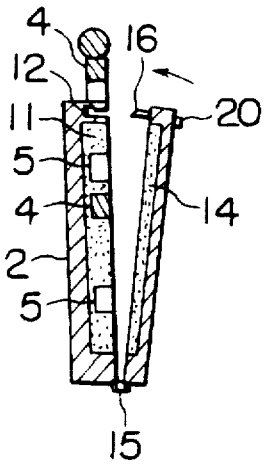

The lid 2 shown in FIGS. 2(*a*) to 2(*c*), like the lid shown in FIGS. 1(*a*) to 1(*c*), accommodates a retainer 14 formed by covering such material as foamed styrol, sponge, etc. with a soft cloth such as velvet or leather. A locking pawl 16 penetrates an upper edge portion of the lid 2 from the outside to the inside for being engaged in the engagement section 12 of the body 1 for engagement.

Third Embodiment

A third embodiment of the invention will now be described in detail with reference to FIGS. 3(*a*) to 3(*c*). The accessory for accommodating finger ring is suited for accommodating a marriage ring with an ornament stone. This accessory is the same in basic structure as the accessory shown in FIGS. 2(*a*) to 2(*c*). It is different in the shape and structure of the case 3 of the body 1. The body 1 is horizontally elongate and has a longitudinally central, large width portion with the ring setting portion 11 provided therein. The ring setting portion 11 again has a central ring accommodating section 5 in the form of a truly circular groove and an upper ring accommodating section 5 in the form of a semicircular groove. The upper ring accommodating section 5 being open on the upper edge of the body 1 so that a ring 4 accommodated in this section has an upper portion projecting outward from the openings 7. The ring setting member 11 has an engaging section 12 formed in its upper portion for engaging the lid 2. The body 1 has its longitudinally opposite end portions formed with through holes 13 for passing an attaching member 6 such as a chain or a string.

Figure 3A:
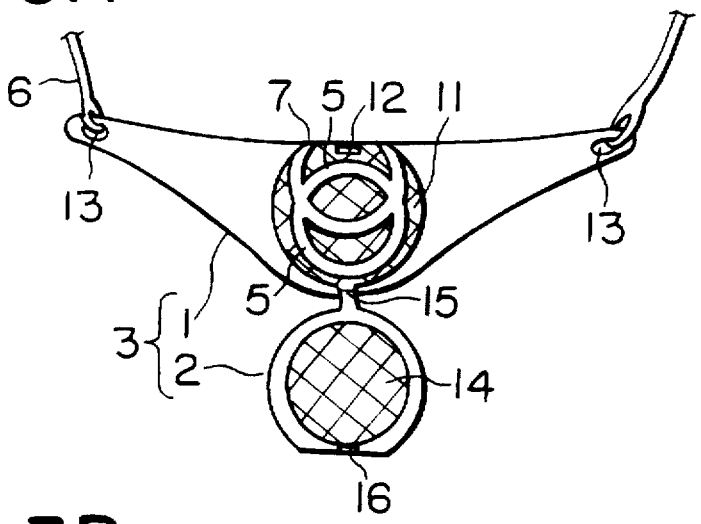
FIGS. 3(*a*) to 3(*c*) show a third embodiment of the invention, FIG. 3(*a*) being a front view showing the accessory with a lid thereof opened, FIG. 3(*b*) being a front view showing the same accessory with the lid opened and a ring accommodated, FIG. 3(*c*) being a front view showing the same in a closed state.
Figure 3B:
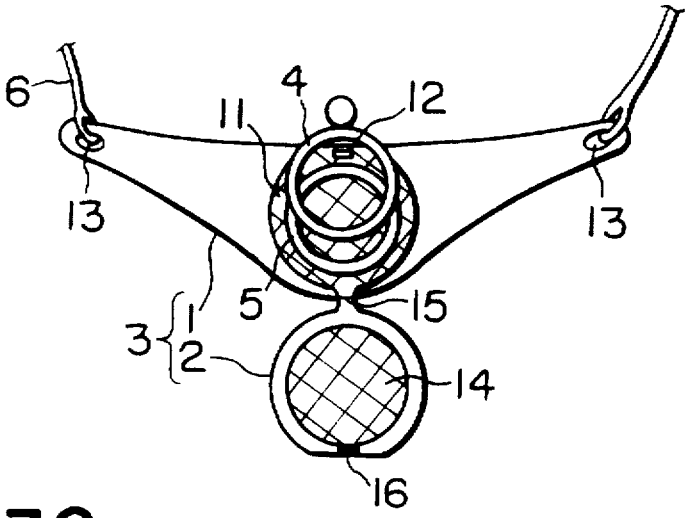
Figure 3C:
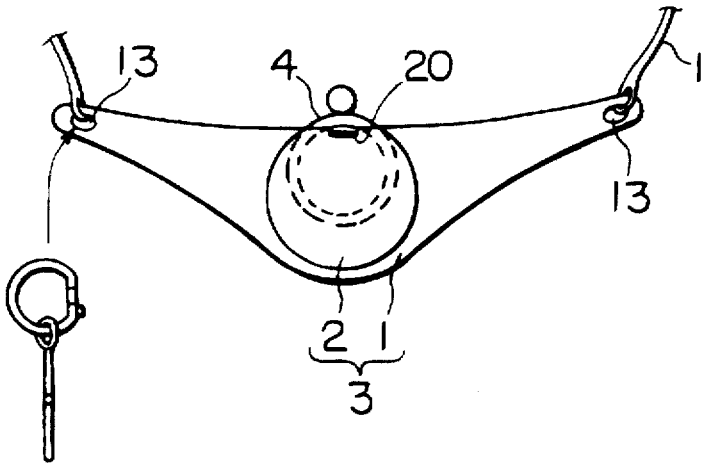
Figure 4A:
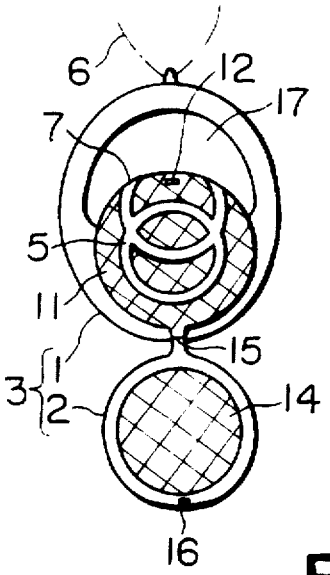
FIGS. 4(*a*) to 4(*d*) show a fourth embodiment of the invention, FIG. 4(*a*) being a front view showing the accessory with a lid thereof opened, FIG. 4(*b*) is a front view showing the same accessory with the lid opened and a ring accommodated, FIG. 4 (*c*) being a front view showing the same in a closed state, FIG. 4(*d*) is a perspective view showing the same in the closed state.
Figure 4B:
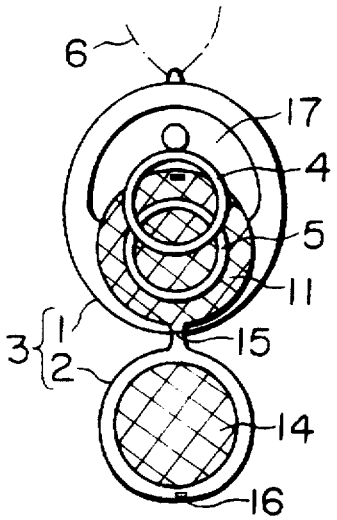
Figure 4C:
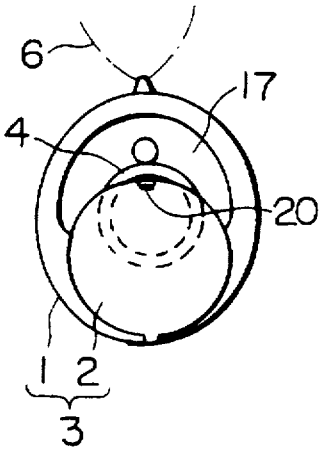
Figure 4D:
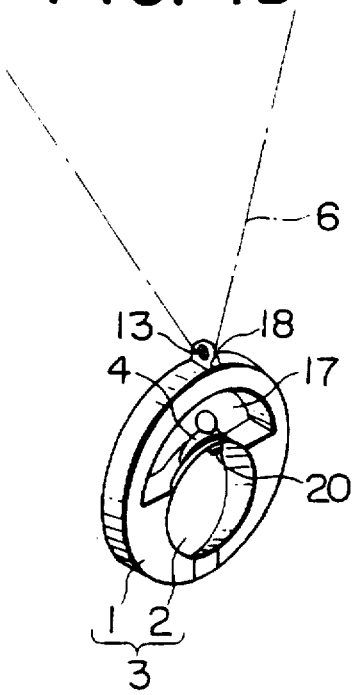

The lid 2 in the case of FIGS. 3(*a*) to 3(*c*) is the same as in the case of FIGS. 2(*a*) to 2(*c*).

Fourth Embodiment

A fourth embodiment of the invention will be described in detail with reference to FIGS. 4 (*a*) to 4 (*d*). The accessory for accommodating finger ring shown in FIGS. 4(*a*) to 4(*d*) is suited for accommodating a marriage ring with an ornament stone. This accessory is gain the same in the basic structure as in the accessory shown in FIGS. 4(*a*) to 4(*d*), and is different in the shape and structure of the body 1 of the case 3. In this instance, the body 1 is slightly vertically oval, and has an upper portion formed with a space 17. Its lower portion accommodates the ring setting member 11 having a central ring accommodating section 5 in the form of the truly circular groove and an upper ring accommodating section 5 in the form of a semicircular groove, the upper ring accommodating section 5 being open to the space 17 in the body 1 so that a ring 4 accommodated in the upper ring accommodating section 5 has an upper portion projecting outward from the openings 7 into the space 17. The ring setting member 11 has an engagement section 12 formed in its upper portion for engaging the lid 2. The body 1 has an upper edge portion provided with a hanging portion 18, which has a through hole 13 for passing an attaching member 6 such as a chain or a string.

The lid 2 in the case of FIGS. 4(*a*) to 4(*d*) is the same as the lid 2 in the case of FIGS. 2(*a*) to 2(*c*).

Fifth Embodiment

Figure 5:
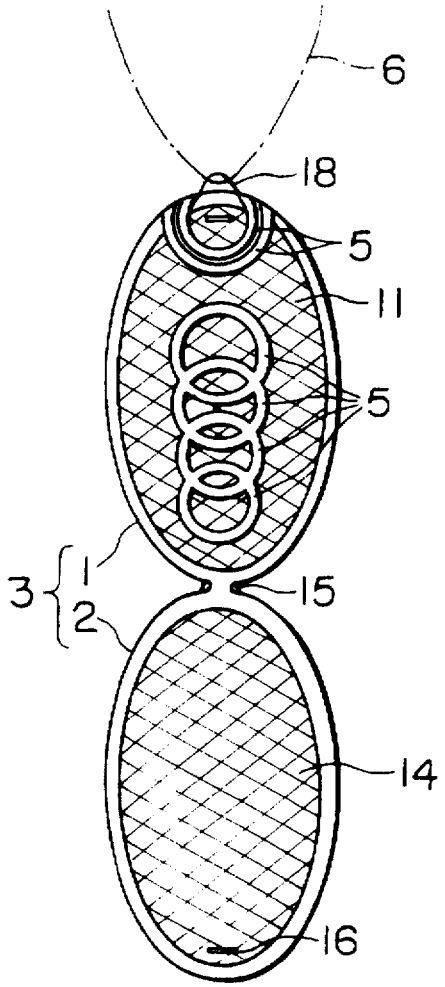
FIG. 5 is a front view showing a fifth embodiment of the invention with a lid opened.

A fifth embodiment of the invention will now be described in detail with reference to FIG. 5. The accessory for accommodating finger ring as shown in FIG. 5 is suited for accommodating a semicircular marriage ring or a ring with an ornament stone. In this accessory, the body 1 is vertically oval, and accommodates the ring setting member 11, which has a plurality of vertically shifted ring accommodating sections 5 in the forms of truely circular grooves having different diameters and further an uppermost ring accommodating section 5 spaced part from the other ring accommodating sections 5 and in the form of a substantially semicircular groove, the uppermost ring accommodating section 5 communicating with the openings 7 formed in the top of the periphery of the body 1 so that a ring 4 accommodated in the uppermost ring accommodating section 5 has an upper portion projecting outward from the openings 7. The ring setting portion 11 has an engagement section 12 formed an upper portion for engaging the lid 2. The periphery top of the body 1 has a hanging portion 18 with a through hole 13 for passing an attachment member 6 such as a chain, a string, etc.

The lid 2 in the case of FIG. 5 is the same as in the case of FIGS. 2(*a*) to 2(*c*).

Sixth Embodiment

Figure 6:
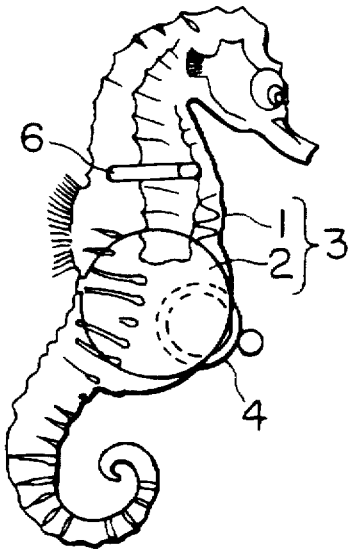
FIG. 6 is a plan view showing a sixth embodiment of the invention.

A sixth embodiment of the invention will now be described in detail with reference to FIG. 6. The accessory for accommodating finger ring as shown in FIG. 6 is suited for accommodating a ring with an ornament stone. This accessory is the same in the basic structure as the accessory shown in FIGS. 2(*a*) to 2(*c*), FIGS. 3(*a*) to FIGS. 3(*c*) and FIGS. 4(*a*) to 4 (*d*), and different only in the shapes of the attaching member 6 and the case 3. The case 3 has a shape of a sea horse. The case 3 has a pin for attaching member 6 provided on its outer periphery for attaching it to the clothing.

Seventh Embodiment

Figure 7A:
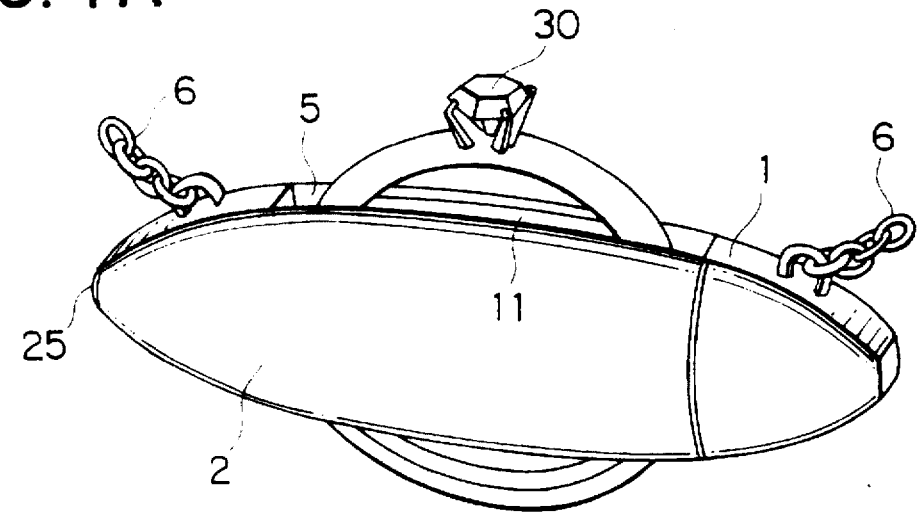
FIGS. 7(*a*) to 7(*c*) show a seventh embodiment of the invention, FIG. 7(*a*) being a perspective view showing the accessory in a closed state, FIG. 7(*b*) being a perspective view showing the same accessory with a lid thereof opened and a ring accommodated, FIG. 7(*c*) being a detail view of A in FIG. 7(*b*).
Figure 7B:
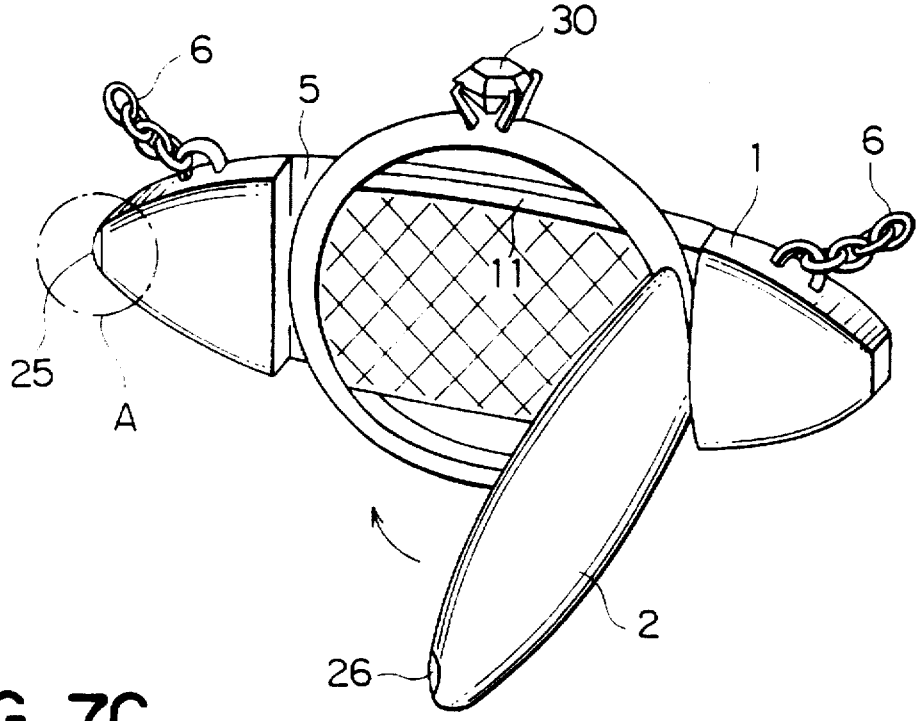
Figure 7C:
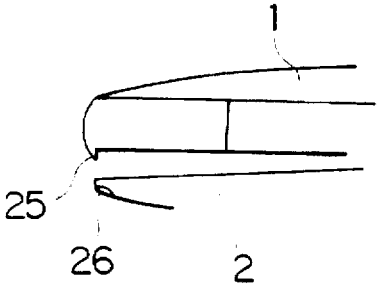

A seventh embodiment of the invention will now be described in detail with reference to FIGS. 7(*a*) to 7(*c*). The accessory for accommodating finger ring is suited for accommodating a ring with an ornament stone. As shown in FIG. 7(*a*), the case 3 of this accessory is elongate. As shown in FIG. 7(*b*), the case 3 accommodates the ring setting member 11 such as to form a ring accommodating section 5 in the form of a groove. As shown in FIG. 7(*a*), when the lid 2 is closed after accommodating ring of the ring 4 in the ring accommodating section 5, an upper portion of the ring 4 with the ornament stone 30 projects from the top and bottom of the case 3 and lid 2, while a lower portion of the ring 4 also projects downward. As shown in FIG. 7(*c*), an end portion of the case 3 has a locking pawl 25, while the lid 2 has a recessed portion 26 formed in the corresponding position. When the lid 2 is closed, the locking pawl 25 is locked in the recessed portion 26, and thus the lid 2 is held closed.

Eighth Embodiment

In any of the above embodiments shown in FIGS. 1(*a*) to 1(*c*) to 7, the case 3 was made up of the body 1 and the lid 2 hinged thereto. In an eighth embodiment of the invention, the case 3 (i.e., at least either the body 1 and the lid 2) is transparent or semitransparent so that an accommodated ring in the case 3 can be seen from the outside.

Ninth Embodiment

In any of the above embodiments shown in FIGS. 1(*a*) to 1(*c*) to 7, the case 3 was made up of the body 1 and the lid 2 hinged thereto. In a ninth embodiment of the invention, a lock (not shown) is provided to lock and unlock the lid to and from the body of the case with the key.

Effects of the invention

With the accessory for accommodating finger ring according to the invention as set forth in claim 1, the following effects are obtainable.

(1) A man who is not inclined to put a ring on a finger, can wear the ring by accommodating the ring in the accessory for accommodating finger ring, and thus one can always carry a very important marriage or engagement ring. It is thus possible to eliminate the possibility of storing the marriage ring or the like in a chest or the like and forgetting the place where the ring has been stored.

(2) The accessory for accommodating finger ring can be worn round the neck just like a necklace or a pendant, or worn on a wrist just like a bracelet or attached to clothing, a bag, a hat, etc. just like a broach or a batch.

(3) The ring can be held reliably in the ring accommodating section and is less prone to damage.

(4) One who is suffering from metal allergy can carry a ring.

With the accessory for accommodating finger ring according to the invention as set forth in claim 2, the following effect is obtainable.

(1) The ornament stone of a ring can project or be exposed outward, so that it can be seen from the outside while the ring is accommodated in the ring accommodating section. The ornament stone thus can be seen without need of opening the lid.

With the accessory for accommodating finger ring according to the invention as set forth in claim 3, the following effect is obtainable.

(1) A ring accommodated in the case can be seen from the outside.

With the accessory for accommodating finger ring according to the invention as set forth in claim 4, the following effect is obtainable.

(1) A ring can be reliably fitted in the ring accommodating section in the form of the circular groove and can be held reliably without possibility of movement in the ring accommodating section.

With the accessory for accommodating finger ring according to the invention as set forth in claim 5, the following effect is obtainable.

(1) The ring portion of a ring can be fitted in one of a plurality of ring accommodating sections in the forms of ring accommodating sections having different diameters. A ring having any ring diameter thus can be reliably accommodated and held in a corresponding one of the ring accommodating sections.

What is claimed is:

1. An accessory that accommodates a finger ring comprising:

a case including:

a body a lid, and a ring accommodating section formed in the case and that at least partially accommodates a ring; and an attaching member provided on the case and capable of attaching the case to clothing or a part of the body of a wearer;

wherein the case further comprises openings that allow a part of a ring placed in the ring accommodating section to project or be exposed outside of the case.

2. The accessory of claim 1, wherein at least one of the lid and the body is transparent or semitransparent, such that a ring placed in the ring accommodating section is observable from outside of the case.

3. The accessory of claim 2, wherein the ring accommodating section comprises a groove capable of accommodating a ring part of a ring.

4. The accessory of claim 3, wherein the ring accommodating section further comprises at least one additional groove, each groove of the ring accommodating section having a different diameter.

5. The accessory of claim 2, wherein the ring accommodating section comprises a plurality of circular grooves, each circular groove of the ring accommodating section having a different diameter.

6. The accessory of claim 1, wherein the ring accommodating section comprises a groove capable of accommodating a ring part of a ring.

7. The accessory of claim 6, wherein the ring accommodating section further comprises at least one additional circular groove, each circular groove of the ring accommodating section having a different diameter.

8. The accessory of claim 1, wherein the ring accommodating section comprises a plurality of circular grooves, each circular groove of the ring accommodating section having a different diameter.

* * * * *